US005323878A

United States Patent [19]

Nakamura et al.

[11] Patent Number: 5,323,878

[45] Date of Patent: Jun. 28, 1994

[54] BRAKING APPARATUS FOR ELEVATOR CAGE

[75] Inventors: Ichiro Nakamura, Katsuta; Tsuyoshi Ogasawara, Ishioka; Masayuki Shigeta; Masakatsu Tanaka, both of Katsuta, all of Japan

[73] Assignee: Hitachi, Ltd., Tokyo, Japan

[21] Appl. No.: 933,235

[22] Filed: Aug. 20, 1992

[30] Foreign Application Priority Data

Aug. 20, 1991 [JP] Japan ..... 3-207798

[51] Int. Cl.[5] ..... B66B 5/00

[52] U.S. Cl. ..... 187/109; 187/89; 188/170

[58] Field of Search ..... 187/108, 109, 116, 20, 187/87, 88, 73; 188/170

[56] References Cited

U.S. PATENT DOCUMENTS 757,789 4/1904 Sundh ..... 187/108

1,924,321 8/1933 James ..... 187/108

FOREIGN PATENT DOCUMENTS 1205022 5/1986 Canada ..... 187/20

*Primary Examiner*—Kenneth W. Noland

*Attorney, Agent, or Firm*—Antonelli, Terry, Stout & Kraus

[57] ABSTRACT

A braking apparatus is provided for an elevator which includes a cage, a counterweight, a main sheave, a motor for rotating the main sheave, a deflector sheave, and a rope wound around the main sheave and the deflector sheave, the rope extending from the cage to the counterweight. The braking apparatus comprises a first brake for the main sheave, and a second brake for the deflector sheave. Both brakes are controlled to apply an appropriate braking force to the cage in accordance with the load and the speed of the cage.

15 Claims, 8 Drawing Sheets

BRAKING APPARATUS FOR ELEVATOR CAGE

FIELD OF THE INVENTION AND ART STATEMENT

The present invention relates to a braking apparatus for an elevator of the type in which a cage is moved upward and downward by a hoisting device through a rope, a sheave and a deflector sheave, and, more particularly, to a braking apparatus for a cage of such elevator.

An elevator is generally provided with a brake which holds a cage in its stop position when the cage is stopped, and safely brakes and stops the cage in the event of an emergency such as a power failure during the travel of the cage. This brake includes shoes which are pressed against a drum under a constant force by a mechanical means, such as a spring, and a frictional force produced at this time brakes or holds the cage. Generally, the frictional force of the brake is the product of the frictional coefficient and the pressing and the frictional coefficient is non-linear and is the function of the sliding speed and the pressing force. Therefore, in order to make the frictional coefficient stable, it is necessary to select a suitable combination of the materials for the drum and the shoe, the optimum pressing pressure. For running the elevator, this pressing force is electrically released, and the cage is driven by a motor or the like.

Such conventional devices are disclosed, for example, in Japanese Patent Unexamined Publication No. 60-148879.

As the elevator size increases and runs at higher speed, the braking force necessary to brake the cage during an emergency increased. In addition, the range of the sliding speed is widened, and then the frictional force of the brake varies substantially according to the conventional means. Further, when the rated load of the cage, which is driven by a sheave through a rope, is set at a higher level, when the load is small, the braking force may overcome the frictional force between the rope and the sheave. Namely, with the conventional structure which merely mechanically applies the pressing force of a constant level to the shoe of the brake in the sheave, even if the combination of the materials of the element is suitably selected, the braking force is too large, a slip develops between the rope and the sheave, so that the cage may fail to be braked effectively. The slip between the rope and the sheave also shortens the lifetime of the rope. Further, a frictional force depending on the sliding speed varies considerably, thereby it is difficult to obtain a stable braking.

As the stroke of travel of the cage is increased, the weight of the rope and other associated parts increases. Therefore, an unbalanced weight becomes relatively smaller but then the inertial mass to be braked increases. Therefore, even though the force required for holding the cage in its stop position is small, a large braking force is required. Namely, the braking force becomes much larger than the force for holding the cage in the stop position. Therefore, when it is intended to produce relatively large braking force by the mechanical means such as a spring, the size of the device becomes large.

OBJECT AND SUMMARY OF THE INVENTION

It is an object of the present invention to provide a braking apparatus by which a braking force of a brake is stabilized by a small-size device over an entire range of speed of travel of a cage from high speed to low speed, thereby achieving a safe operation of the elevator.

To this end, according to the present invention, there is provided a braking apparatus which comprises a first brake for a main sheave and a second brake for the deflector sheave, and a control device for controlling these brakes, thereby obtaining a total braking force optimal for braking the cage.

According to the present invention, a slip between the sheaves and the rope is eliminated, thereby reducing the damage of the rope. Furthermore, the braking force is optimized for the inertial mass to be braked and its speed, and therefore the cage can be safely stopped with a small braking impact and with the shortest braking distance.

DETAILED DESCRIPTION OF THE PREFERRED EMBODIMENTS

Figure 1:
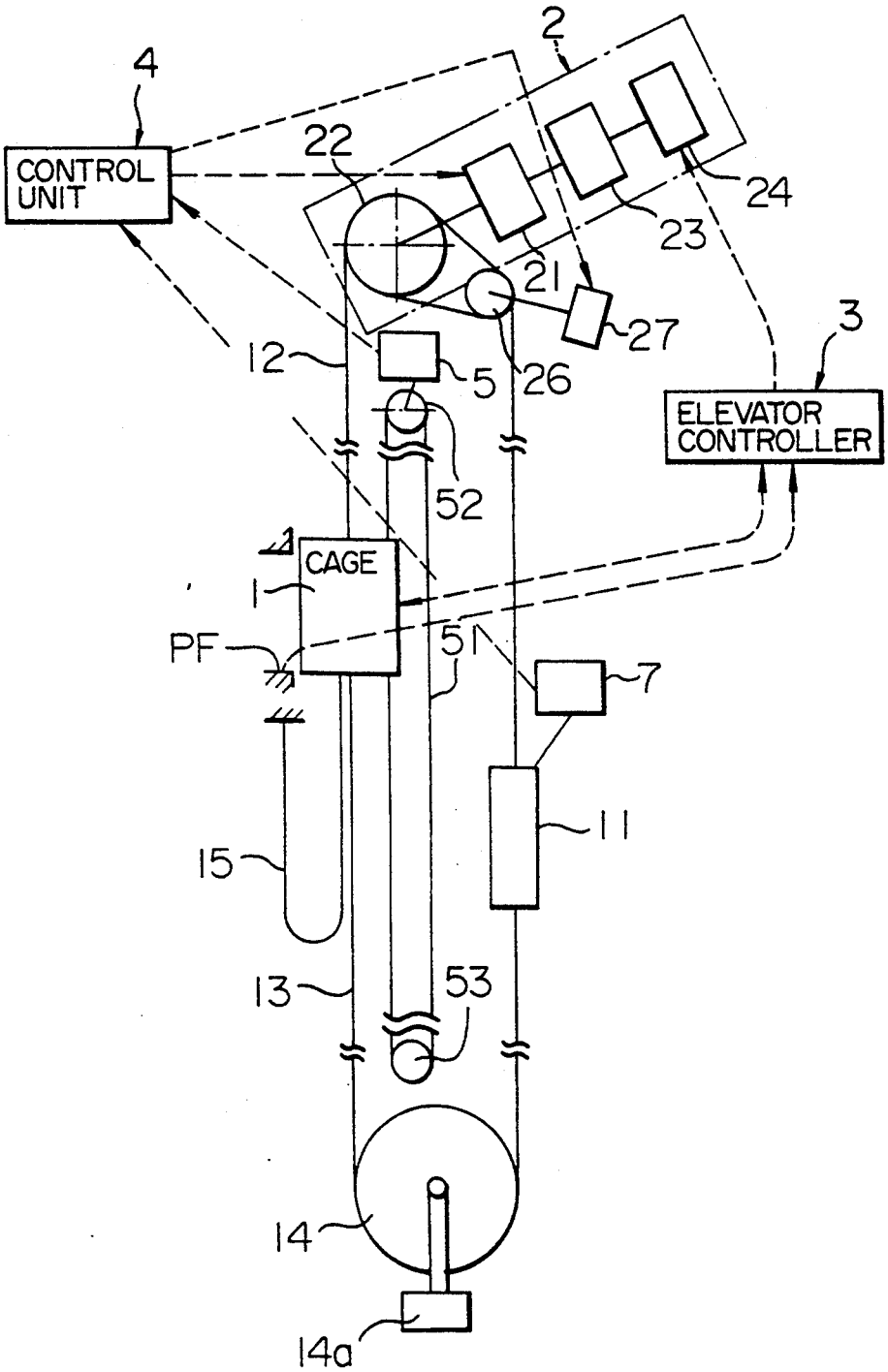
FIG. 1 is a schematic view showing an elevator to which a braking apparatus according to one embodiment of the present invention is applied.
Figure 2:
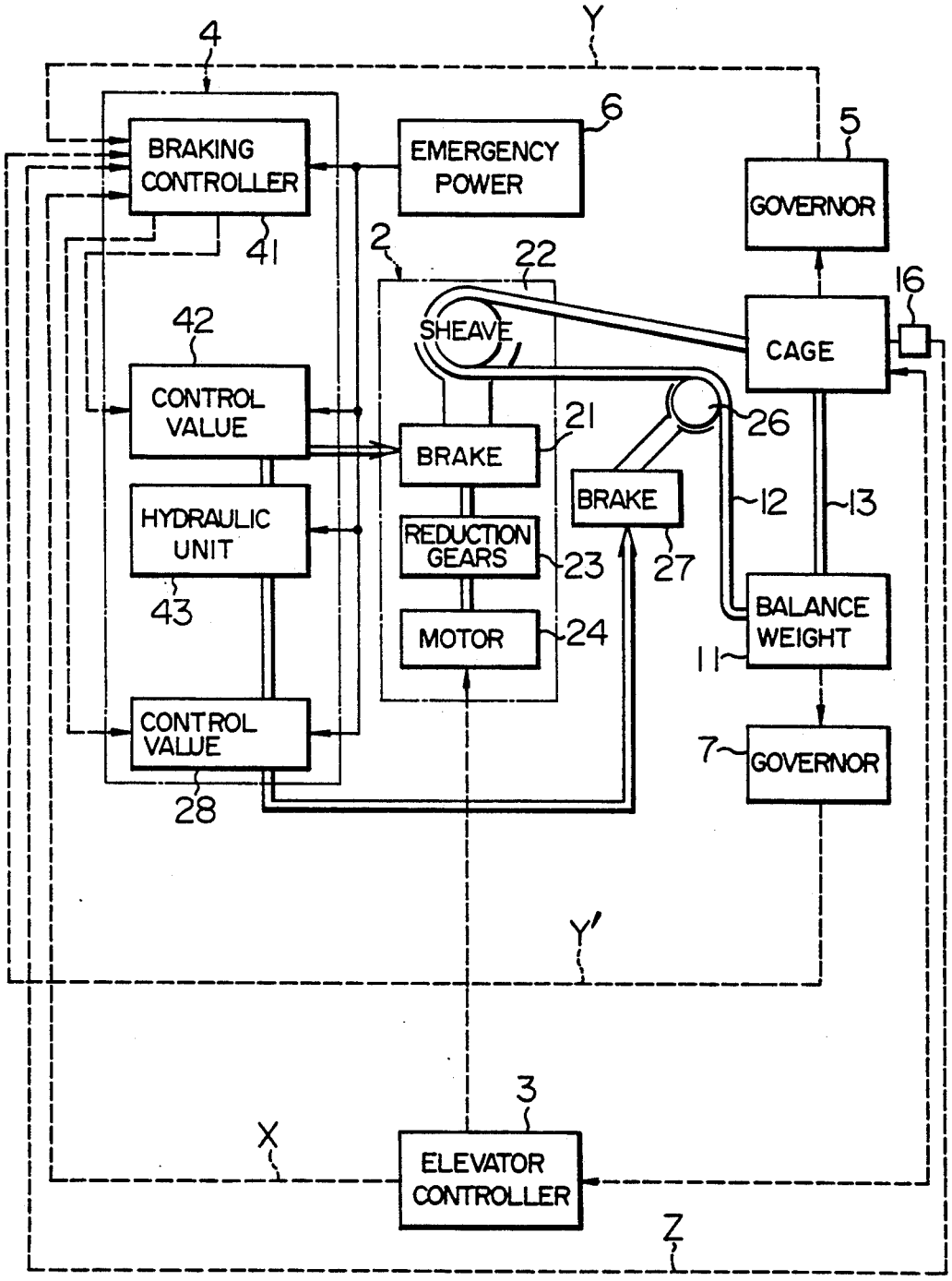
FIG. 2 is a block diagram showing the elevator of FIG. 1.

Referring to FIGS. 1 and 2, an elevator, to which an braking apparatus according to one embodiment of the present invention is applied, comprises a cage 1, a device 2 for driving the cage 1, an elevator controller 3, and a control unit 4 for brakes 21 and 27. The cage 1 and a balance weight 11 are interconnected by a main rope 12, extending around a sheave 22, and a deflector sheave 26, and also they are interconnected by a compensator rope 13 extending around a compensator pulley 14. Necessary electricity and control signals are supplied to the cage 1 through a tail cord 15. The compensator pulley 14 and a weight **14*a* attached thereto impart an appropriate tension to the main rope 12 to make a contact force between the sheave 22 and the rope 12 proper. A governor 5 is driven by a governor rope 51 extending through governor pulleys 52 and 53. The governor 5 detects the speed of the cage 1 and particularly an abnormal speed thereof, and sends an abnormal speed signal to a braking controller 41 of the control unit 4 directly or through the controller 3. Another governor 7 is provided in the balance weight 11 for sending an abnormal speed signal to the braking controller 41. The drive device 2 comprises the brake 21, the sheave 22, reduction gears 23, and a motor 24. The rotation of the motor 24 is reduced by the reduction gears 23, and then is transmitted to the sheave 22 to drive the cage 1 and the balance weight 11 via the main rope 12. The brake 21** is provided for braking the sheave 22 and the brake 27 is provided for braking the deflector wheel 26. The brakes 21 and 27 hold the cage 1 in its stop position when the cage 1 is stopped, and also brake the cage 1 in the event of an emergency. The elevator controller 3 manages and controls the driving device 2 in accordance with a calling signal from each floor (platform) PF and a destination signal from the cage 1, and the display of guidance signs at the platform and the cage 1, and the operation of a plurality of elevators. In accordance with a command signal X from the 5 elevator controller 3, signals Y and Y' from the governors 5 and 7 and a signal Z from a detection means 16 which detects, for example, the inertial mass and speed of the cage 1, the braking controller 41 calculates the braking forces optimal for the operating condition at that time, and converts them into a pressure braking force of each of hydraulic cylinders of the brakes 21 and 27. The braking controller 41 controls control valves 42 and 28 so as to control the pressure of fluid from a hydraulic unit 43 to be supplied to the hydraulic cylinders of the brakes 21 and 27, and then controls the pressures (braking forces). Even in the event of a power failure or the like, an emergency power source 6 can supply power to the devices and the equipment, such as the braking controller 41, the control valves 42, 28 and the hydraulic unit 43 which are required for maintaining the safety of the elevator.

Figure 3:
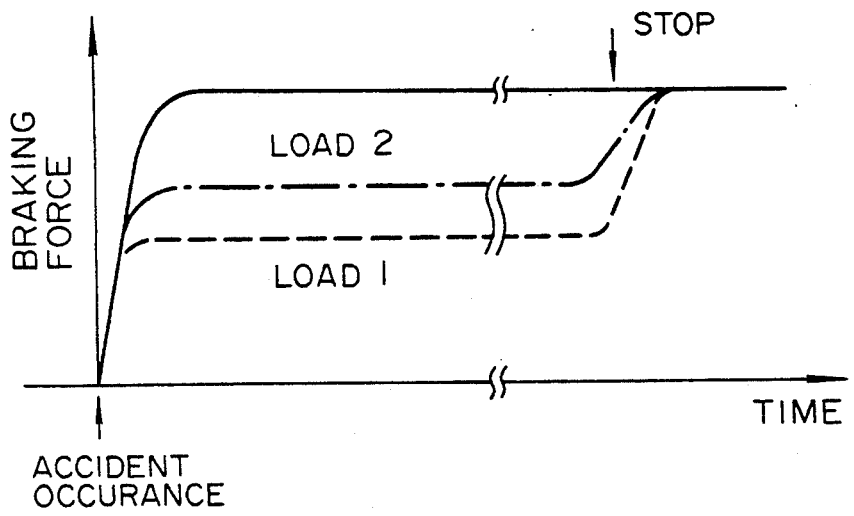
FIG. 3 is a graphical illustration of an operation of the brake during an emergency.

In the normal operation of the elevator, the brakes 21 and 27 apply the braking forces when the elevator is stopped, and release them the brakes 21 and 27 before the elevator is started, and the speed control of the cage 1 is all effected by the motor 24. During the operation of the elevator (that is, during the release of the brakes 21 and 27), when an accident occurs (for example, if the cage 1 runs at a speed higher than the rated speed, so that the governor 5 detects an abnormal speed, or if the motor 24 fails to work as a result of a power failure), the braking controller 41 operates the control valve 42 to stop the cage 1 without delay. At this time, when an unbalanced weight or an inertial force is large, a larger braking force is required. Therefore, in order to increase a frictional force between the main rope 12 and the sheave 22, the main rope 12 is wound in several turns between the sheave 22 and the deflector sheave 26. However, the number of turns is limited in respect of the structure thereof, and the frictional force generated by the sheave 22 is also limited. Therefore, according to the present invention, another brake 27 is provided for the deflector sheave 26 to generate the braking force. Accordingly, a total braking force is enlarged. The optimum braking force is calculated in accordance with the load condition (the magnitude of the total inertial mass) and the travel speed so that the braking impact of the cage 1 may not become excessive and that a slip may not develop between the rope 12 and the sheave 22 and the deflector sheave 26, and the brakes 21 and 27 are controlled in accordance with this optimum braking force. Therefore, as shown in FIG. 3, the optimum braking force, which is optimum for the respective load conditions, is rapidly produced upon occurrence of the accident so as to decelerate and stop the cage 1, and there is produced the holding force capable of positively holding the cage 1 in its stop position after the cage 1 is stopped. When the load is large on the descent of the cage 1, the braking force varies as indicated, by a solid line. When the load is small, upon the ascent of the cage 1 (LOAD 1), the braking force varies as indicated by a broken line. To the contrary, when the load is large on the ascent of the cage 1, the braking force varies as indicated as a chain line.

Figure 4:
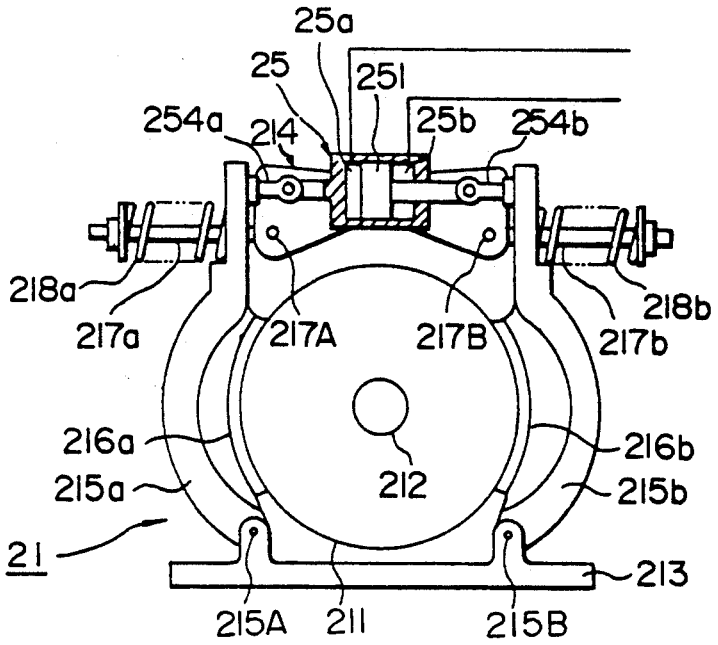
FIG. 4 is a view of the brake shown in FIG. 1.
Figure 4A:
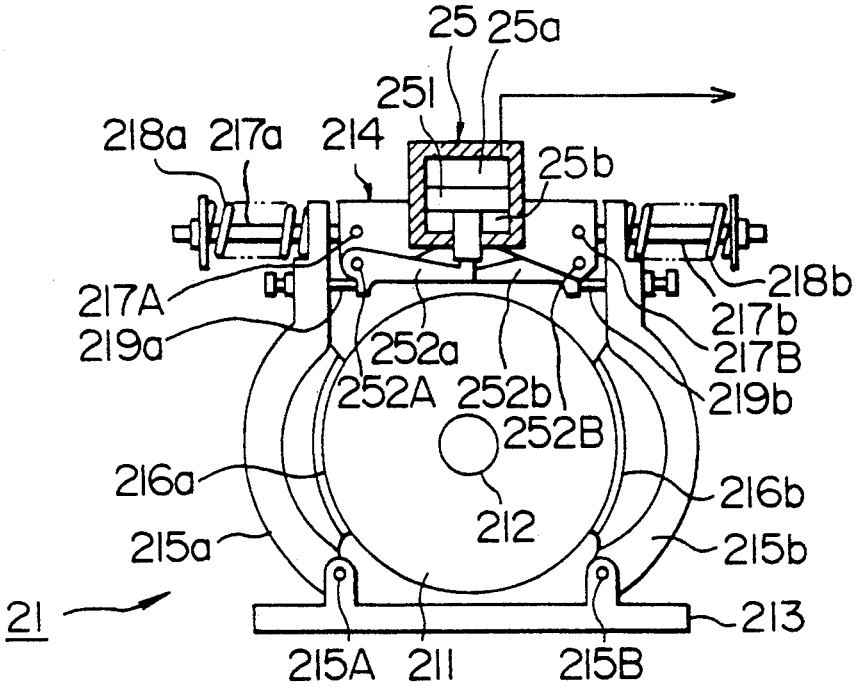
FIG. 4A is a view showing modified brake.

In a brake 21, 27 used in one embodiment of the present invention shown in FIG. 4, a drum 211 is fixedly mounted on a drive shaft 212, and is rotated in clockwise and counterclockwise directions in accordance with the upward and downward movements of the cage 1. A bed 213 and a stationary frame 214 are fixed onto a base (not shown) of the driving device 2 of the elevator. Arms 215*a* and 215*b* having the respective shoes 216*a* and 216*b* are pivotally mounted to the bed 213 through pins 215A and 215B, respectively. The arms 215*a* and 215*b* are urged toward the frame 214 by rods 217*a* and 217*b* and springs 218*a* and 218*b* to produce the braking force. The rods 217*a* and 217*b* are mounted to the frame 214 by pins 217A and 217B, respectively. The movement of a piston 251 of a hydraulic cylinder 25 is transmitted to the arms 215*a* and 215*b*, respectively. Namely, when a fluid pressurized to a predetermined level, is applied to a chamber 25*b* of the hydraulic cylinder 25 through a control valve 42, 28, the arms 215*a* and 215*b* are moved close to each other by the fluid pressure as well as the spring forces of the springs 218*a* and 218*b* so as to press the shoes 216*a* and 216*b* against the drum 211. In case that the springs 218*a* and 218*b* have spring forces enough to press the shoes 216*a* and 216*b* against the drum 211 and brake it, the fluid application to the chamber 25*b* can be omitted (FIG. 4A). When a fluid controlled in the pressure thereof is applied to a chamber 25*a* of the hydraulic cylinder 25, the piston 251 overcomes the springs 218*a* and 218*b* to move the shoes 216*a* and 216*b* apart from the drum 211 to release the brake. By controlling the pressure of fluid supplied through the control valve 42, 28 to a chamber 25*b* of the hydraulic cylinder 25, the output of the piston 251, that is, the force of pressing of the shoes 22 against the drum 211, can be controlled, thereby controlling the braking force. In order to ensure that the force of the piston 251 can be uniformally transmitted to the arms 215*a* and 215*b*, members 254*a* and 254*b* are provided for adjusting the gap between the links and the arms.

In the normal condition of the elevator, when the cage 1 is stopped, in the brake 21, the shoes 216*a* and 216*b* are pressed against the drum 211 by the spring forces of the springs 218*a* and 218*b* and the fluid pressure in the chamber 25*b* so as to generate the frictional force, which prevents the movement of the drive shaft 212. To the contrary, in accordance with commands for the elevator operation, the fluid of high pressure is supplied to the chamber 25*a* of the hydraulic cylinder 25 to push the piston 25 so as to overcome the forces of the springs 218*a* and 218*b* and the fluid pressure in the chamber 25*b*, so that the shoes 216*a* and 216*b* are moved apart from the drum 211 to release the brake. Thereafter, the motor 11 accelerates, decelerates and makes the cage 1 move upwardly or downwardly. When the cage 1 is stopped, the high-pressure fluid is discharged from the chamber 25*a*, so that the springs 218*a* and 218*b* and the fluid in the chamber 25*b* press the shoes 216*a* and 216*b* against the drum 211, thereby holding it. The brake 27 also brakes and releases the deflector sheave 26 in synchronization with the braking and releasing of the brake 21. Therefore, the cage 1 is braked and released by a synchronized operation of the brakes 21 and 27.

When an accident occurs during the operation of the elevator (or the high-pressure fluid is supplied to the hydraulic chamber 25*a* to keep the brakes 21 and 27 released), the braking, force required for the brake varies in dependence upon the load as shown in FIG. 3, for example, whether the load is large or small, or whether the cage 1 moves upwardly or downwardly. In accordance with the signals from the elevator controller 3 and the governors 5 and 7, the braking controller 41 determines the optimum braking force for the operating condition at that time, that is, the optimum pressure of the hydraulic cylinder 25. The braking controller 41 controls the pressure control valves 42 and 28 to discharge the high-pressure fluid from the hydraulic cylinder 25, so that the shoes 216*a* and 216*b* are pressed against the drum 211 under the influence of the springs 218*a* and 218*b*, thereby braking the sheave 22 and the deflector sheave 26 by the friction force produced between the shoes 216*a* and 216*b* and the drum 211. By doing so, slippage between the main rope 12 and the sheave 22 and the deflector sheave 26 are prevented when applying the braking, and then the cage 1 can be braked and stopped with a small braking impact and also with the shortest braking distance.

The stroke of travel of the cage 1 becomes long in a multi-stored building having many floors. In this case, in order to enhance the transport efficiency, the capacity of the cage 1 is increased so as to accommodate an increased number of passengers, and also the cage 1 is designed to run at a high speed. As a result, the load mass (passengers or freight) is increased. However, the inertial masses of the cage 1 and the balance weight 11 as well as the weight of the main rope 12 and the compensator rope 13 balanced with it are increased at a large rate. Namely, the increase of the inertial mass becomes larger than the increase of the unbalance weight due to a change of the number of passengers. As a result, the braking forces of the brakes 21 and 27 required for braking the running inertial mass is relatively larger than the holding forces of the brakes 21 and 27 required for statically holding the cage 1. Therefore, if the braking force depends entirely on the pressing force of the springs 218*a* and 218*b*, these springs are increased in size and then the device is also increased in size, and the installation space is also increased. The force pressing the shoes 216*a* and 216*b* against the drum 211 is shared between the spring forces of the springs 218*a* and 218*b* and the fluid pressure in the chamber 25*b*. The pressing force is adapted to be released by supplying pressurized fluid into the chamber 25*a*.

The brakes 21 and 27 are not limited to the drum brake, but the brakes may be a disk brake.

Figure 5:
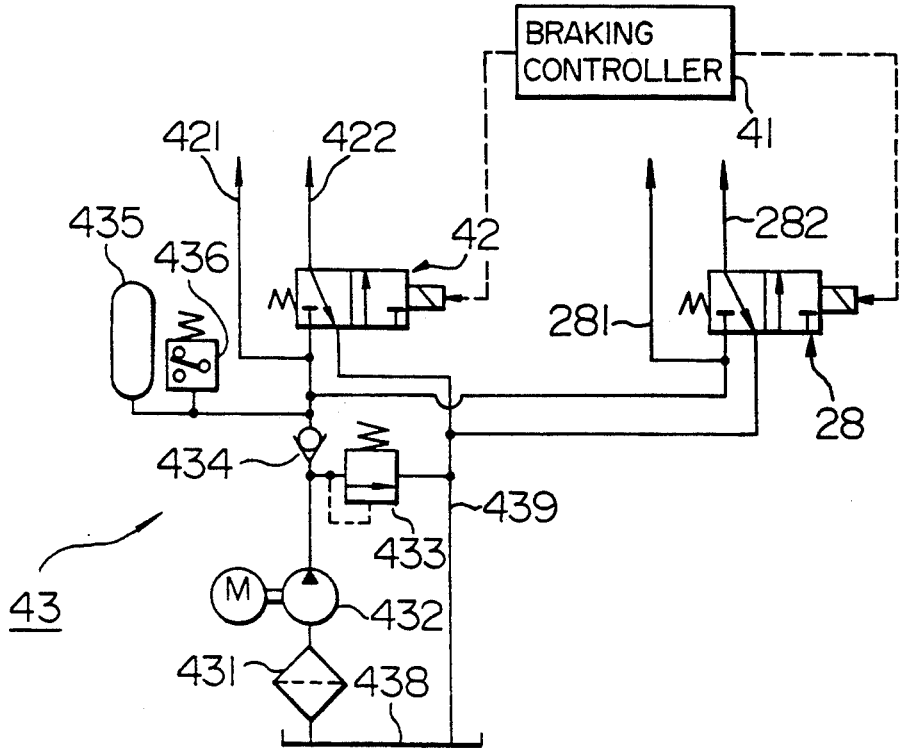
FIG. 5 is a circuit diagram of a hydraulic system for driving a hydraulic cylinder used in the embodiment of the invention.

Referring to FIG. 5, the control circuit 4 for controlling the hydraulic cylinder 25 includes the braking controller 41, control valves 28 and 42, and a hydraulic unit 43. The hydraulic unit 43 comprises a filter 431, a motor driven hydraulic pump 432, a relief valve 433, a check valve 434, an accumulator 435, a pressure switch 436, and a fluid tank 438. A working fluid from a fluid tank 438 is pressurized and pumped by the hydraulic pump 432, and is accumulated in the accumulator 435. At this time, the hydraulic pump 432 is operated or stopped by a signal from the pressure switch 436 to always monitor the pressure of the fluid accumulated in the accumulator 435 at a generally constant level. The filter 431 removes foreign matter from the fluid. The relief valve 433 prevents the pressure at the outlet of the pressure pump 432 from becoming unduly high. The check valve 434 prevents the fluid from flowing in a reverse direction toward the pump 432 even when the pump 432 is stopped. The accumulator 435 is communicated with the chamber 25*b* of the hydraulic cylinder 25 of the brake 21 through a line 421 so as to maintain the pressure in the chamber 25*b* in a high level. The control valve 42 releases the fluid from the chamber 25*a* through a line 422. In response to an instruction from the braking controller 41, the control valve 42 is switched over to supply the high-pressure fluid from the accumulator 435 to the chamber 25*a* of the hydraulic cylinder 25 so as to control the pressure in the chamber 25*a*. The accumulator 435 is also communicated with the chamber 25*b* of the hydraulic cylinder 25 of the brake 27 through a line 281. The control valve 28 releases the fluid from the chamber 25*a* of the hydraulic cylinder 25 of the brake 27 through a line 282. In response to an instruction from the braking controller 41, the control valve 28 is also switched over.

Namely, in a normal operation of the elevator, in accordance with the instruction from the braking controller 41, the high-pressure fluid is supplied from the accumulator 435 to the chambers 25*a* to release the brakes 21 and 27. To the contrary, when the cage 1 is stopped, the high-pressure fluid is discharged from the chambers 25*a* to set the brakes 21 and 27. At this time, in order to effect the release and setting of the brake rapidly, the flow rate is preferable large. When an accident, such as a power failure, occurs during the travel of the elevator, the braking controller 41 calculates the optimum braking force (that is, the force of pressing of the shoes 216*a* and 216*b* against the drum 211) in view of the magnitude of the inertial mass an the travel speed at that time. The braking controller 41 converts this force into the desired pressure of the hydraulic cylinder 25, and sends instructions to the pressure control valves 42 and 28. In response to the instructions from the braking controller 41, the pressure control valves 42 and 28 are switched over to allow the high-pressure fluid to be discharge from the chambers 25*a* to set the brakes 31 and 27. At this time, since the capacity of the chamber 25*a* is small, the pressure of the chamber 25*a* greatly decreases even when a small amount of the fluid is discharged from the chamber 25*a*. Therefore, the control valves 42 and 28 effect the pressure control between the high pressure in the accumulator 435 and the low pressure in the tank 438. By doing so, the braking force can be controlled in the above-mentioned manner. Thus, it is necessary for the control valves 42 and 28 to effect both the flow rate control in the normal operation and the pressure control in the emergency.

Figure 6:
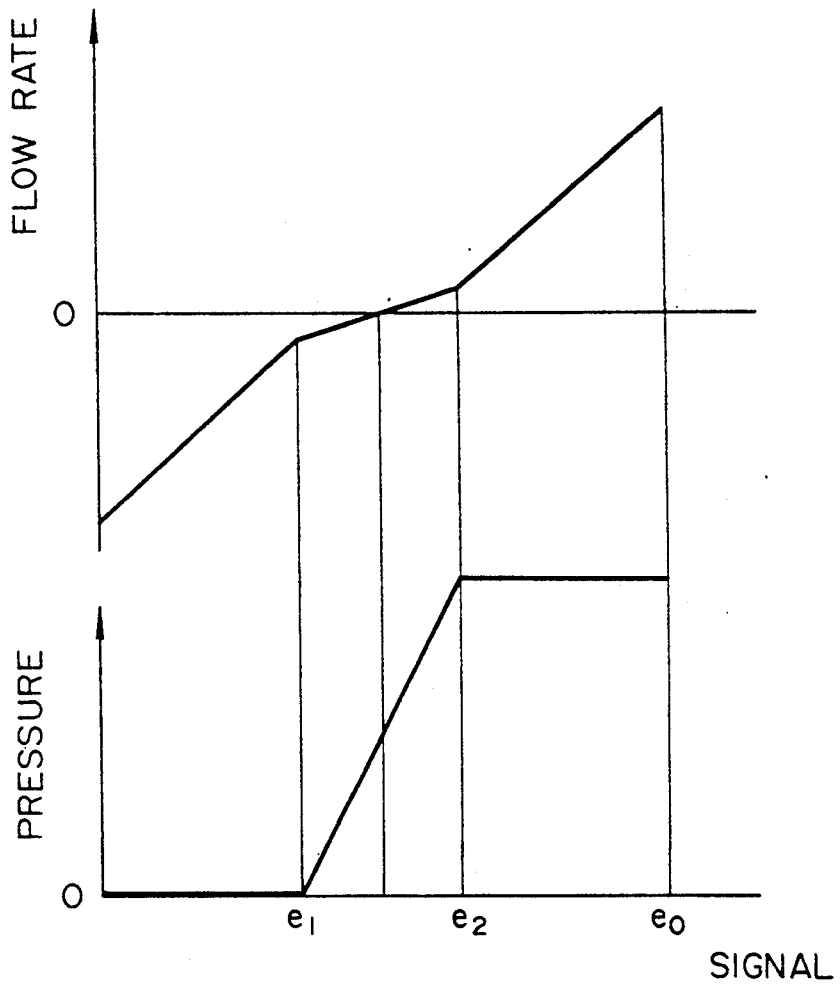
FIG. 6 is a graphical illustration of characteristics of a control valve.

FIG. 6 shows characteristics of the flow control valves 42 and 28. The abscissa represents a magnitude of instruction signal, and the ordinate represents the controlled flow rate of fluid flowing through the control valve 42, 28 and the pressure thereof. The positive flow rate represents a flow rate of fluid flowing from the accumulator to the cylinder chamber. To the contrary, the negative flow rate represents a flow rate of fluid flowing from the cylinder chamber to the tank. When the instruction signal is "0", the chamber of the hydraulic cylinder is fully communicated with the tank. When the instruction signal is the rated value "$e_0$", the accumulator is fully communicated with the chamber of the hydraulic cylinder. The values $e_1$" and "$e_2$" which are less than the value "$e_0$" are so set that $e_1$" is smaller than "$e_2$". The range of between "0" and $e_1$" and the range of between "$e_2$" to "$e_0$" define the flow rate control ranges, and the range of between $e_1$" and "$e_2$" defines the pressure control range. When the instruction signal is "0", the flow lines 422 and 282 are communicated with a low pressure flow passage 439, so that the chambers 25*a* of the cylinders 25 of the brakes 21 and 27 are opened to the low pressure. As the instruction signal reaches $e_1$", the flow rate of the fluid from the lines 422 and 282 to the passage 439 becomes small. When the instruction signal is beyond "$e_2$", the flow rate of the fluid from the accumulator 435 to the lines 421 and 281 becomes large. Further, when the instruction signal reaches "$e_0$", the flow rate becomes maximum and then the fluid of high pressure is supplied to the respective chambers 25*a*. When the instruction signal is between $e_1$" and "$e_2$", since a flow rate gain is small but a pressure gain is large, the pressures in the chambers 25*a* can be considerably controlled in accordance with the instruction signal.

Figure 7A:
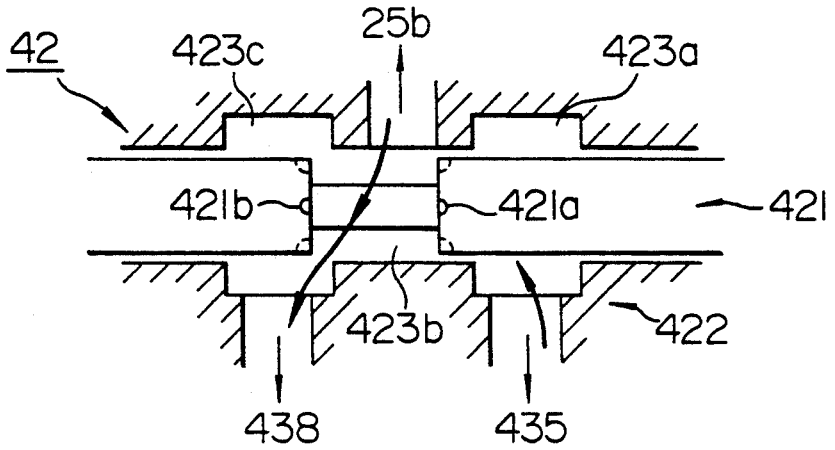
FIGS. 7A to 7C are partial cross-sectional views showing the operation of the control portion of the control valve.
Figure 7B:
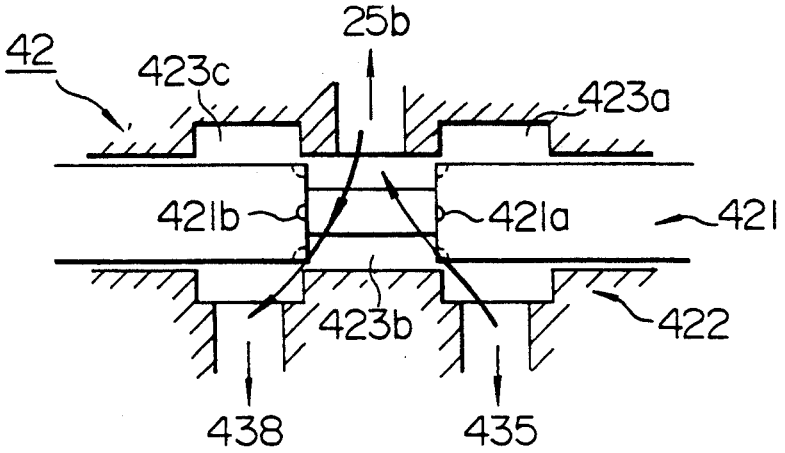
Figure 7C:
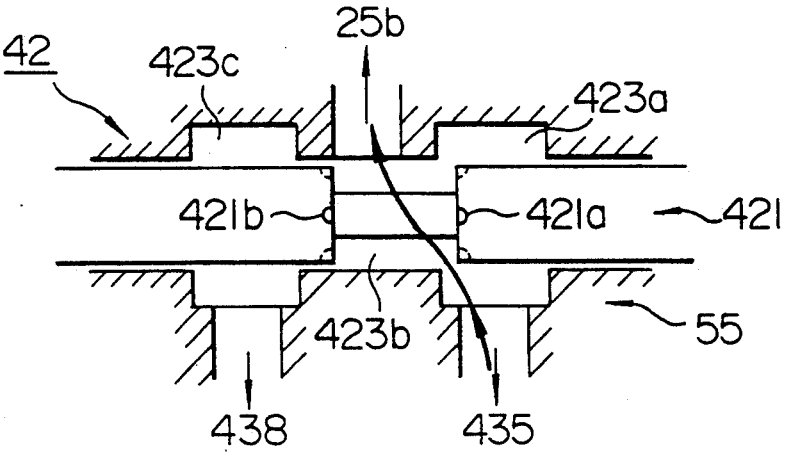

One example of the construction of the control portion of the control valve 42 or 28 is shown in FIGS. 7A–7C. The constructions of the control valves 28 and 42 are identical. Therefore, the explanation will be mainly be given with respect to the control valve 42. The control valve 42 includes a spool 421 having notches 421*a* and 421*b* formed on land portions thereof and a sleeve 422 within which the spool 421 axially moves. They define therebetween chambers 423*a*, 423*b* and 423*c* which are communicated respectively with the accumulator 435, the chamber 25*b* of the cylinder 25, and the tank 438. When there is no instruction signal or the instruction signal is "0", the spool 421 is in a left end portion as shown in FIG. 7A, and then the chamber 25*b* of the cylinder 25 of the brake 21 is communicated with the tank 438 to release the brake 21. When the instruction signal is in a rated level or "$e_0$", the spool 421 is moved to a right end portion as shown in FIG. 7C, and then the chamber 25*b* of the cylinder 25 of the brake 21 is communicated with the accumulator 435 to set the brake 21. When the instruction signal is at half of the rated level, the spool 421 is in a neutral position shown in FIG. 7B. The chamber 25 is communicated with the accumulator 435 and the tank 438 through the notches 421*a* and 421*b*. Accordingly, as described above, the flow rate gain becomes small and the pressures in the chambers 25*a* can be sensitively controlled.

Figure 8:
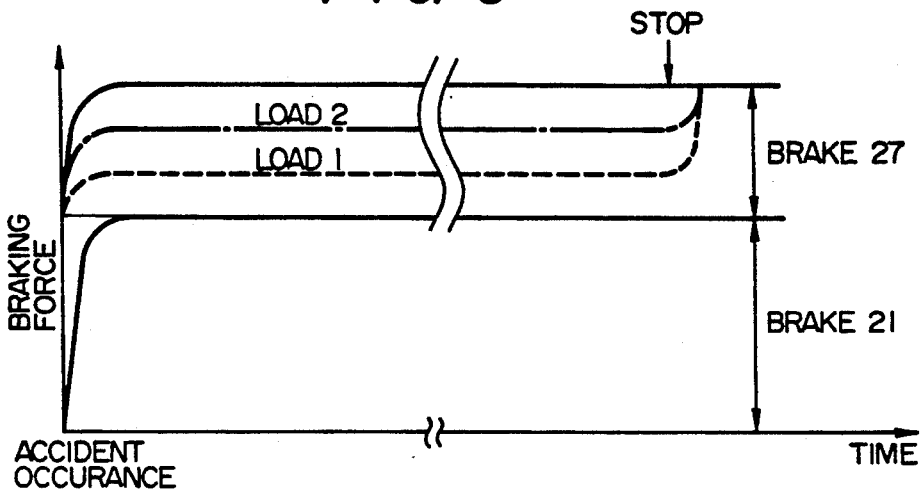
FIGS. 8 to 10 are diagrammatic views showing modified operations of the brake, respectively.

In FIG. 8, the brake 21 always contributes a constant braking force and the brake 27 contributes a controlled braking force in accordance with the load, in order to obtain a desired total braking force.

Figure 9:
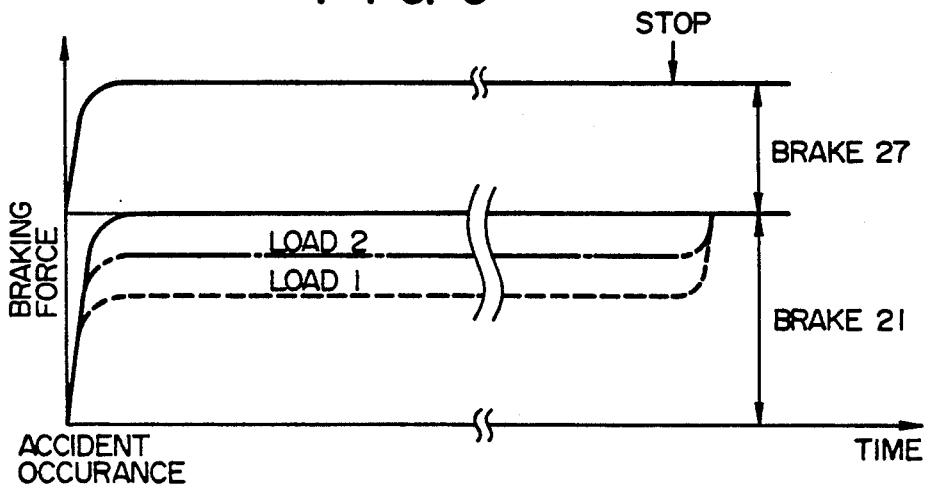

To the contrary, in FIG. 9, the brake 27 always contributes a constant braking force and the brake 21 contributes a controlled braking force in accordance with the load, in order to obtain a desired total braking force.

In these cases, an ON-OFF valve can be employed instead of the control valve 42 or 27, which is simple in construction as compared with the control valve, thereby reliability is improved.

Figure 10:
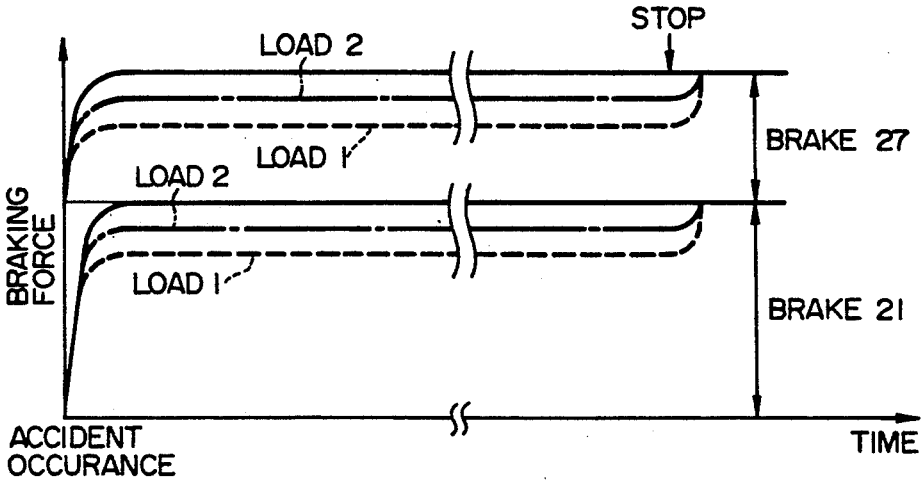

In FIG. 10, not only the brake 21 but also the brake 27 varies the braking force in accordance with the load. In this case, it is possible to control these valves 21 and 27 by the same instruction signal.

According to the present invention, a desired total braking force is obtained from two brakes which are provided for the sheave and the deflector sheave, respectively. Therefore, the share braking force contributed by either brakes becomes small, thereby preventing an occurrence of slip between the main rope and the sheave and the deflector sheave. Furthermore, the brake can be controlled with a high responsibility, and its braking force can be controlled arbitrarily. Even in the event of a power failure, the brake can be operated by the emergency power source of a small-capacity. Therefore, in the normal condition, the cage can be held accurately in its stop position, and in the event of an emergency, the optimum braking force is produced in accordance with the load and the speed of the cage, and the shortest braking distance can be achieved with a small braking impact. Thus, the reliable and safe elevator can be obtained.

What is claimed is:

1. In an elevator including a cage, a counterweight, a main sheave, a motor for rotating said main sheave, a deflector sheave, and a rope wound around said main sheave and said deflector sheave, said rope extending from said cage to said counterweight, a braking apparatus comprising:

a first means for braking said main sheave;

a second means for braking said deflector sheave; and a control device for controlling said first and second means, wherein each of said first and second means includes spring means for providing a braking force and hydraulic cylinder means for releasing said braking force due to said spring means, said hydraulic cylinder means is connected with a control valve which changes a flow rate of fluid to be supplied to said cylinder means but maintain a pressure of said fluid in a predetermined range of a magnitude of an instruction signal, and which changes the pressure of said fluid but substantially maintains the flow rate of said fluid in another range of magnitude of said instruction signal, said control device includes means for detecting a speed of said cage and/or a load of said cage, and means for calculating a desired pressure of said cylinder means in accordance with a signal from said detecting means and for operating said control valve in accordance with a result of the calculation, and wherein said control valve is connected to a hydraulic circuit including an accumulator.

2. An apparatus according to claim 1, wherein said hydraulic circuit is provided with an emergency power.

3. In an elevator including a cage, a counterweight, a main sheave, a motor for rotating said main sheave, a deflector sheave, and a rope wound around said main sheave and said deflector sheave, said rope extending from said cage to said counterweight, a braking apparatus comprising:

first means for braking said main sheave;

second means for braking said deflector sheave; and a control device for controlling said first and second means, wherein each of said first and second means includes spring means or providing a braking force and hydraulic cylinder means for releasing said braking force due to said spring means, said hydraulic cylinder means is connected with a control valve which changes a flow rate of fluid to be supplied to said cylinder means but maintain a pressure of said fluid in a predetermined range of a magnitude of an instruction signal, and which changes the pressure of said fluid but substantially maintains the flow rate of said fluid in another range of magnitude of said instruction signal, said control device includes means for detecting a speed of said cage and/or a load of said cage, and means for calculating a desired pressure of said cylinder means in accordance with a signal from said detecting means and for operating said control valve in accordance with a result of the calculation, and wherein said control device is provided with an emergency power.

4. In an elevator including a cage, a counterweight, a main sheave, a motor for rotating said main sheave, a deflector sheave, and a rope wound around said main sheave and said deflector sheave, said rope extending from said cage to said counterweight, a braking apparatus comprising:

first means for braking said main sheave;

second means for braking said deflector sheave; and a control device for controlling said first and second means, wherein each of said first and second means includes spring means for providing a braking force and hydraulic cylinder means for releasing said braking force due to said spring means, and wherein said control device includes means for detecting a speed of said cage and/or a load of said cage, and means for calculating a desired pressure of said cylinder means in accordance with a signal from said detecting means and for controlling said first and second braking means in accordance with the result of the calculation.

5. An apparatus according to claim 4, wherein said hydraulic circuit is provided with an emergency power.

6. An apparatus according to claim 4, wherein said control device is provided with an emergency power.

7. In an elevator including a cage, a counterweight, a main sheave, a motor for rotating said main sheave, a deflector sheave, and a rope wound around said main sheave and said deflector sheave, said rope extending from said cage to said counterweight, a braking apparatus comprising:

first means for braking said main sheave;

second means for braking said deflector sheave; and a control means for controlling said first and second means, wherein said control device includes means for detecting a speed of said cage and/or a load of said cage, and means for calculating a desired braking force enough to stop said cage and a shortage of braking force in accordance with a signal from said detecting means and for controlling said first and second braking means in accordance with said braking forces, respectively.

8. An apparatus according to claim 7, wherein said hydraulic circuit is provided with an emergency power.

9. An apparatus according to claim 7, wherein said control device is provided with an emergency power.

10. In an elevator including a cage, a counterweight, a main sheave, a motor for rotating said main sheave, a deflector sheave, and a rope wound around said main sheave and said deflector sheave, said rope extending from said cage to said counterweight, a braking comprising:

first means for braking said main sheave;

second means for braking said deflector sheave; and a control device for controlling said first and second means, wherein such control device includes means for detecting a speed of said cage and/or a load of said cage, and means for operating said first braking means to apply a constant braking force and for controlling said second braking means in accordance with a signal from said detecting means.

11. An apparatus according to claim 10, wherein said hydraulic circuit is provided with an emergency power.

12. An apparatus according to claim 10, wherein said control device is provided with an emergency power.

13. In an elevator including a cage, a counterweight, a main sheave, a motor for rotating said main sheave, a deflector sheave, and a rope wound around said main sheave and said deflector sheave, said rope extending from said cage to said counterweight, a braking apparatus comprising:

first means for braking said main sheave;

second means for braking said deflector sheave; and a control means for controlling said first and second means, wherein said control device includes means for detecting a speed of said cage and/or a load of said cage, and means for operating said second braking means to apply a constant braking force and for controlling said first braking means in accordance with a signal from said detecting means.

14. An apparatus according to claim 13, wherein said hydraulic circuit is provided with an emergency power.

15. An apparatus according to claim 13, wherein said control device is provided with an emergency power.

* * * * *